United States Patent [19]

Monvoisin

[11] 4,404,904

[45] Sep. 20, 1983

[54] AUTOMATIC SILK-SCREEN PRINTING MACHINE INCLUDING AN ELECTROMAGNET DEVICE FOR MOVING THE DOCTOR BLADE DOWNWARDS

[75] Inventor: Jacques Monvoisin, Paris, France

[73] Assignee: Societe Tecal, France

[21] Appl. No.: 332,638

[22] Filed: Dec. 21, 1981

[51] Int. Cl.[3] ..... B05C 17/06; B41F 15/08

[52] U.S. Cl. ..... 101/126

[58] Field of Search ..... 101/114, 123, 125, 126, 101/129

[56] References Cited

U.S. PATENT DOCUMENTS

| | | | |
|---|---|---|---|
| 2,845,859 | 8/1958 | Gattuso | 101/126 |
| 3,492,942 | 2/1970 | Forslund | 101/126 X |
| 3,973,490 | 8/1976 | Black | 101/126 X |
| 4,109,573 | 8/1978 | Strauch et al. | 101/126 X |

FOREIGN PATENT DOCUMENTS

| | | | |
|---|---|---|---|
| 965299 | 4/1975 | Canada | 101/126 |
| 2005101 | 8/1971 | Fed. Rep. of Germany | 101/126 |
| 2402836 | 7/1975 | Fed. Rep. of Germany | 101/126 |
| 2314831 | 2/1977 | France | 101/126 |
| 55-39310 | 3/1980 | Japan | 101/126 |
| 1396443 | 6/1975 | United Kingdom | 101/126 |

*Primary Examiner*—E. H. Eickholt

*Attorney, Agent, or Firm*—William A. Drucker

[57] ABSTRACT

An automatic silk-screen printing machine including means for synchronized control of movements comprising a relative linear movement between the screen and a doctor blade, a downward movement of the doctor blade and a simultaneous upward movement of the member which holds the object to be printed, characterized by a mechanism for moving the doctor blade holder (14) downwards and upwards, comprising a pivoting arm (15) the pivot point (16) of which is fixed relative to the means for linearly moving the doctor blade, means (18) for yieldingly returning said arm to a position corresponding to the up position of the doctor blade, a member (17) having an abutment plate above said arm, a link (19) the pivot pin (190) of which is integral with said arm and at one end of which is mounted the axle of a wheel (191) bearing against said abutment surface, a rod (20) connected at one end thereof to said link so as to cause it to oscillate about its pivot pin, an electromagnet (21) having a movable member integral with the opposite end of said rod and means for causing temporary energization of said electromagnet to control downward movement of the doctor blade.

2 Claims, 5 Drawing Figures

AUTOMATIC SILK-SCREEN PRINTING MACHINE INCLUDING AN ELECTROMAGNET DEVICE FOR MOVING THE DOCTOR BLADE DOWNWARDS

BACKGROUND OF THE INVENTION

Automatic silk-screen printing machines include usually complex means for synchronized control of the relative movements of the screen, the doctor blade and the object to be printed. These movements include, in a known type of machines, a relative linear movement between the screen and the doctor blade (in printing of planar surfaces, the screen is stationary, whereas in printing of cylindrical surfaces the doctor blade is stationary), a downward movement of the doctor blade and a simultaneous upward movement of the member on which the object is supported.

OBJECT OF THE INVENTION

It is an object of the invention to make said screen control means simpler in design.

SUMMARY OF THE INVENTION

The machine in accordance with the invention comprises a mechanism for moving the doctor blade holder downwards and upwards, comprising a pivoted arm the pivot point of which is fixed with respect to means for linearly moving the doctor blade, means for yieldingly returning said arm to a position corresponding to the up position of the doctor blade, a member having an abutment surface above said arm, a link having a pin integral with said arm and at one end of which is mounted the axle of a wheel bearing against said abutment surface, a rod connected at one end thereof to said link so as to cause it to oscillate about its pin, an electromagnet haing a movable member integral with the opposite end of said rod, and means for temporarily energizing the electromagnet to control the downward movement of the doctor blade.

BRIEF DESCRIPTION OF THE DRAWING

Other features and the advantages of the invention will become apparent from the following description.

In the appended drawings.

DESCRIPTION OF THE PREFERRED EMBODIMENT

Figure 1:
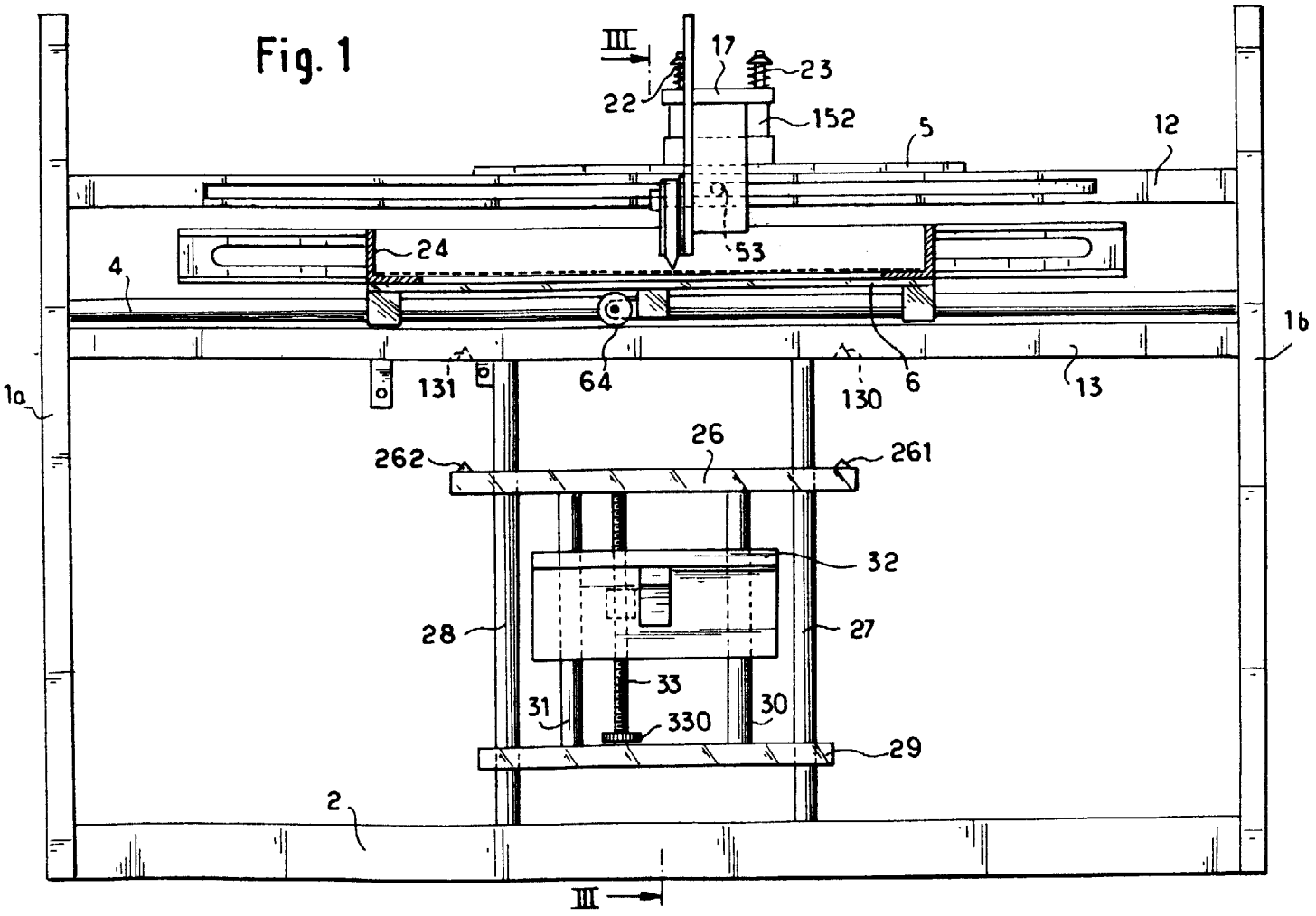
FIG. 1 is an elevation view of the front side of a machine in accordance with a preferred embodiment of the invention, in which the machine cover has been removed.
Figure 2:
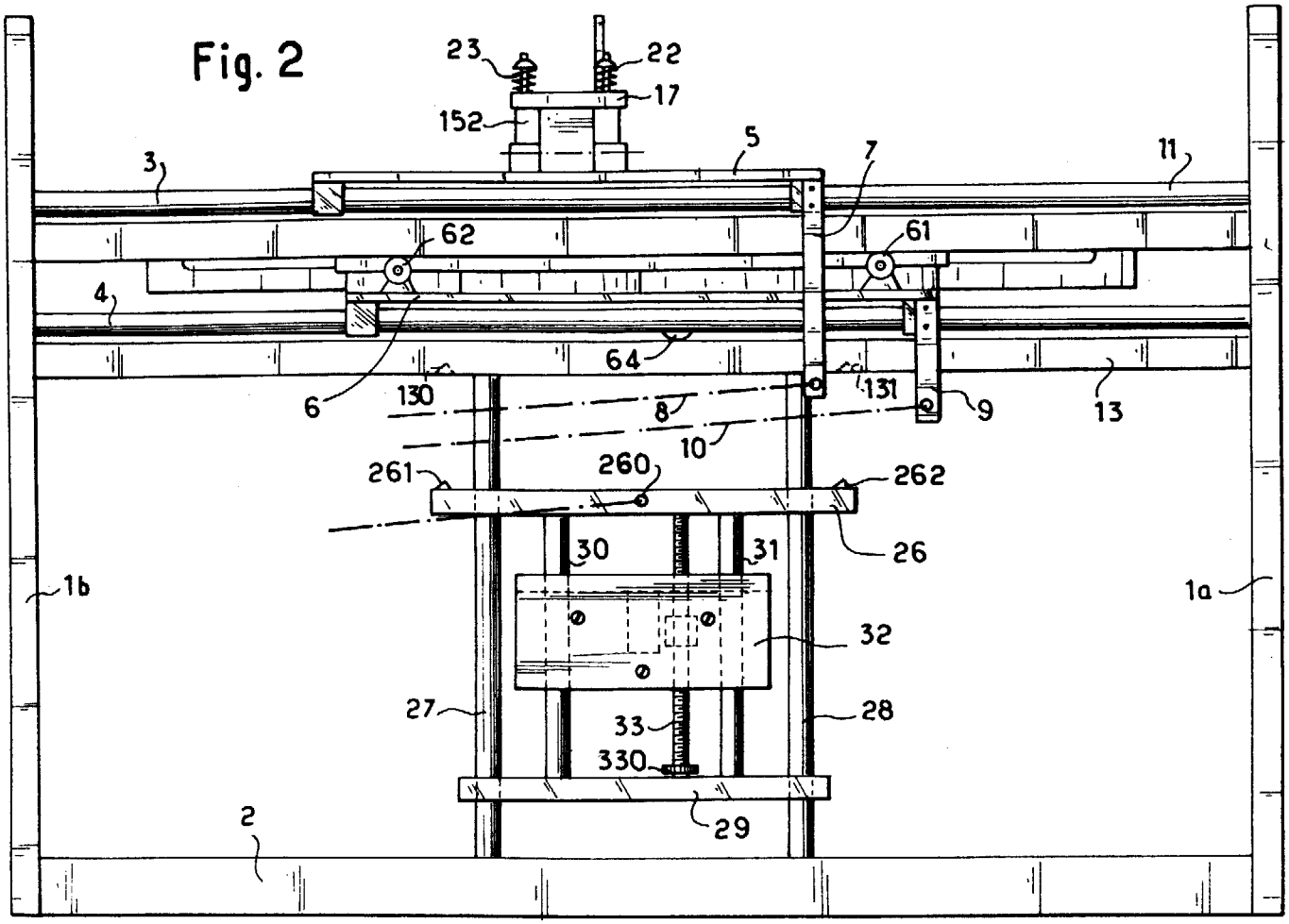
FIG. 2 is an elevation view of the rear side of said machine.
Figure 3:
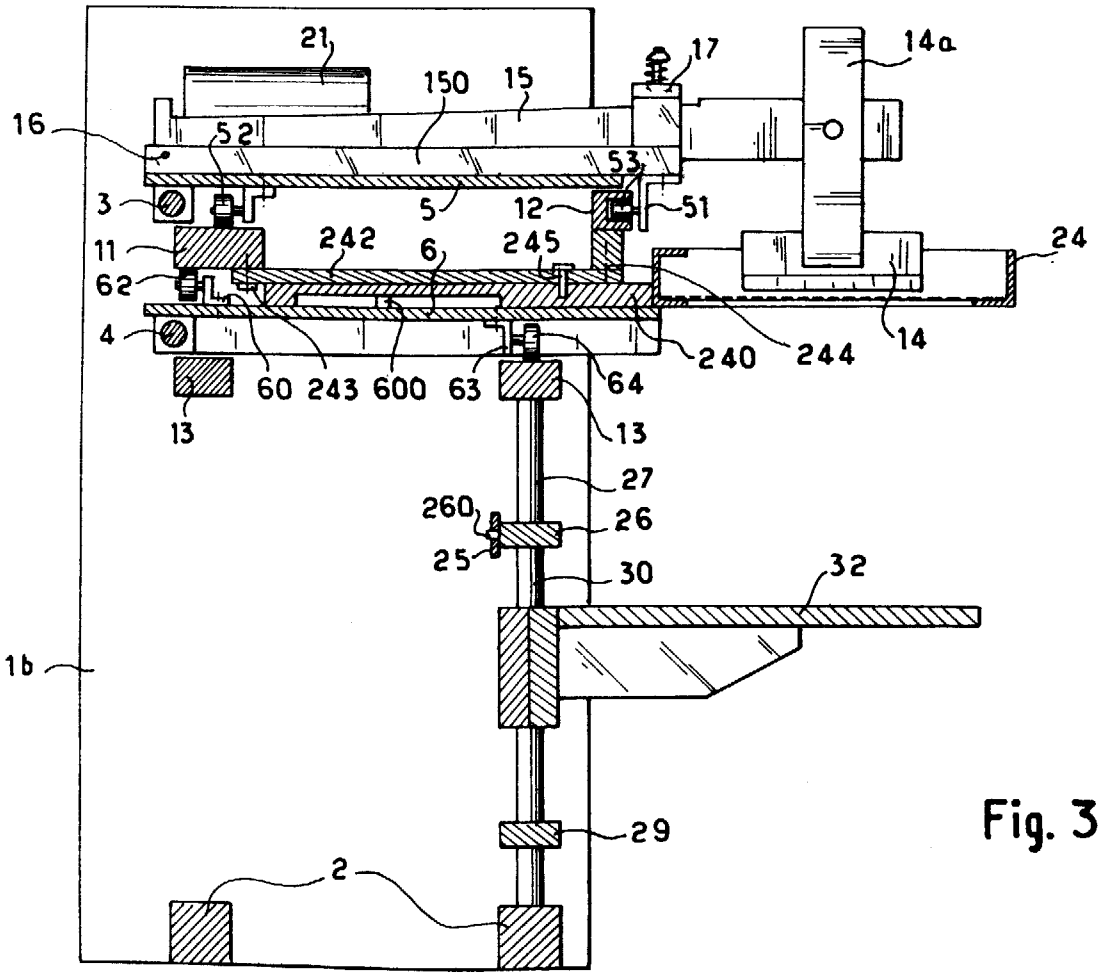
FIG. 3 is a sectional view along line III—III of FIG. 1.

Referring now more particularly to FIGS. 1, 2 and 3, the frame 1*a*, 1*b*, 2 of the machine supports adjacent its rear side a pair of horizontally extending tubes 3, 4 on which slide a table 5 supporting the doctor blade holder and a table 6 supporting the screen holder, respectively. One or the other of said tables (depending upon the kind of surfaces to be printed) is driven, from a motor (not shown), by one of the linkage systems 7-8 or 9-10, respectively.

On the underside of table 5 are mounted brackets 50, 51 for supporting axles of respective center rollers 52, 53. Roller 52 rolls on the upper side of an horizontally extending guide bar 11 connected to vertical legs 1*a*, 1*b* of the frame, and roller 53 rolls in a groove provided in an horizontally extending guide bar 12 which is also connected to vertical legs 1*a* and 1*b*. Both rollers provide a stiff guiding of the sliding movement of table 5, thus preventing any bending of tube 3.

Likewise, on the upper side of table 6 are mounted a pair of brackets 60 for supporting the axles of a pair of rollers 61, 62 which roll on the lower side of bar 11, and on the underside of table 6 is mounted a bracket 63 for supporting the axle of a roller 64 which rolls on the upper side of an horizontally extending guide bar 13 which is connected to vertical legs 1*a* and 1*b* of the frame.

There will now be described, with particular reference to FIGS. 4 and 5, the doctor blade holder and the mechanism for moving the doctor blade upwardly and downwardly. The doctor blade, which is not shown, is mounted on a member 14, 14*a* which is secured to a pivoting arm 15 the pivot 16 point of which is fixed with respect to table 5 (see also FIGS. 1 and 3).

Figure 4:
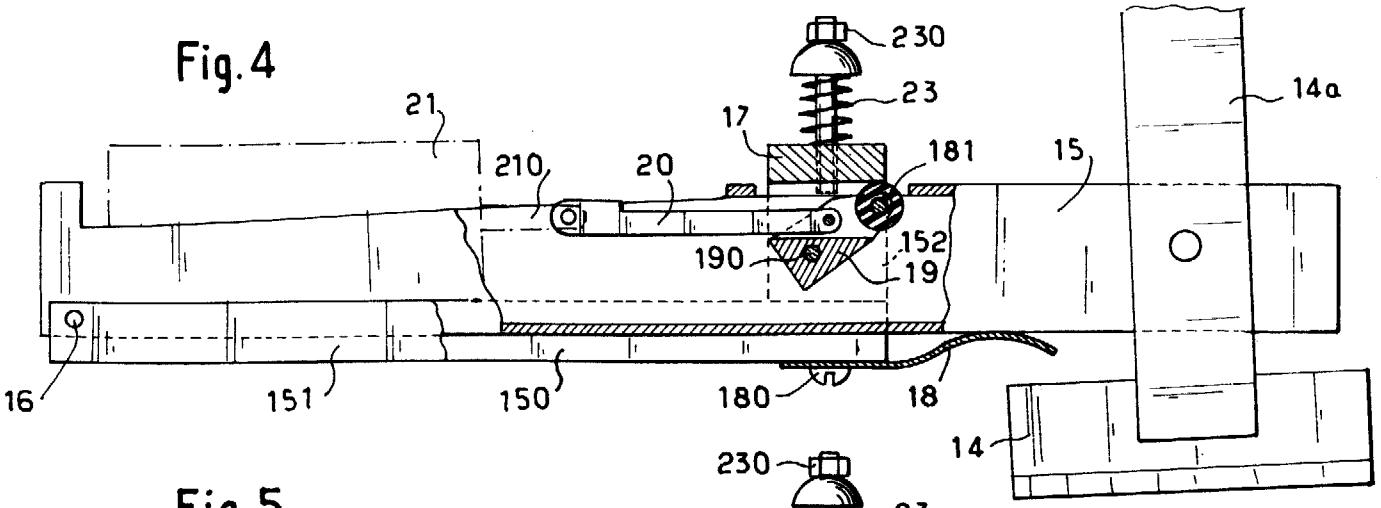
FIG. 4 shows, in its inoperative position, the pivoted or oscillating arm included in the doctor blade holder of said machine.
Figure 5:
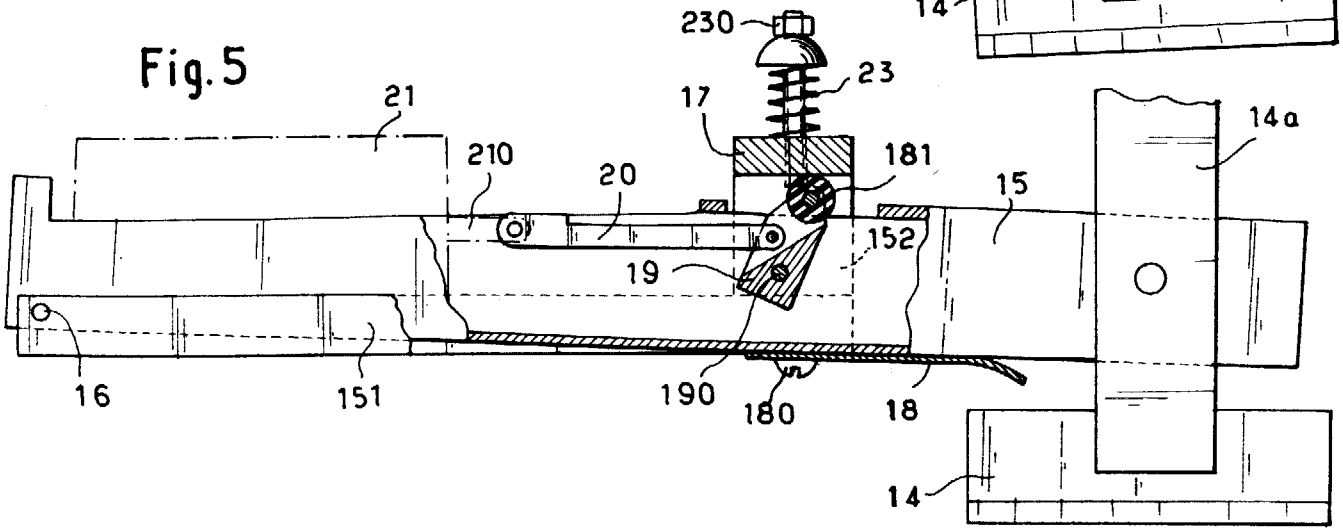
FIG. 5 is a view of said oscillating arm when the doctor blade is in its down position.

FIGS. 4 and 5 show that arm 15 is sandwiched between two members 150 and 151 which are secured above table 5 and to which are in turn secured two columns 152 supporting an abutment plate 17 and an electromagnet 21.

In front of table 5 is disposed that portion of said up and down mechanism which is stationary (with respect to table 5), said portion comprising the horizontally extending abutment plate 17 above arm 15 and a return or release spring 18 (secured by a screw 180) below arm 15, with which said spring cooperates. A link 19 is provided with its pivot pin 190 integral with arm 15 and is caused to oscillate about said pin by a rod 20 connected with the movable member 210 of electromagnet 21. Link 19 supports at one end thereof the axle of a roller 191 bearing against the lower side of plate 17.

When the electromagnet is not energized, arm 15 is horizontally disposed (FIG. 4). When the electromagnet is energized, a pull force (towards the left in the drawing) acts upon rod 20, which results in a pivoting movement of the link which rolls on abutment plate 17, and thence in a downward movement of link pin 190. As a result, arm 15 abruptly assumes the down position as shown in FIG. 5. A pair of springs 22, 23 (FIGS. 1 and 4) press on plate 17 with a pressure force which can be adjusted by means of nuts such as 230.

There is thus obtained an adjustment of the stiffness of the yielding abutment provided by plate 17, and thence an adjustment of the velocity of the downward movement. Once the electromagnet is no longer energized, spring 18 returns arm 15 in its up position. Energization of the electromagnet is controlled by a switch (not shown) which in turn is control led by a cam part of a conventional mechanism for synchronizing the linear movement of the screen or doctor blade with the downward movement of the doctor blade.

There will now be briefly described, the mechanism for driving the screen holder 24. The latter, which can also be seen in FIG. 3, is made integral with a plastic member 140 which rests upon table 6 and is driven, when table 6 is linearly moved for printing of a cylindrical or frustoconical object, by a nipple 600 which is integral with table 6 and engages into a port 141 provided in member 240.

For printing of cylindrical or planar objects, it is only necessary that member 240 remains stationary with respect to table 6 which is linearly moved, thence member 240 and table 6 are secured to each other by means of pins engaging into openings after the hereinafter described means, which embody a rotation axis of member 240, have been removed.

For printing of conical objects, on the other hand, member 240 must be rotated about a fixed axis which must be as close to member 24 as the taper angle of the object is greater.

A generally triangularly-shaped member 242 overlies member 240. Member 242 is secured to bar 11 by means of a member 243 (FIG. 3) and to bar 12 by means of a member 244.

Thus, table 6 is linearly moved relative thereto during printing of conically-shaped objects.

Members 240 and 242 are connected to each other by means of a member 245 which allows them to rotate relative to each other (rotation axis of member 240). Where point 245 remains stationary and the axis of a post or bearing 600 integral with table 6, which runs through a port provided in member 240, is linearly moved, member 240 is in turn rotated about pivot pin 245.

When it is desired to adjust the position of the rotation center, said member will be inserted into one of the openings (not shown) provided in member 242.

The inoperative position of nipple 600 can in turn be adjusted to provide proper rotation of member 242 depending upon the position of pivot pin 245. The mechanism which controls the upward and downward movement of the object will now be briefly described.

It includes a crank 25 connected at point 260 to a horizontal bar 26 which is adapted to slide on guiding tubes 27-28 in turn secured, at one end, to bar 13 and, at the opposite end, to base 2 of the frame.

The object supporting means including furtherance of bar 26, a bar 29 which also slides on tubes 27-28 and is integrally connected to bar 26 through posts 30-31, on which the object-supporting member 32 proper is mounted. A screw 33 controlled by a wheel 330 enables one to adjust the height of member 32.

It should be understood that various changes can be made in the machine as described and shown without departing from the spirit of the invention.

We claim:

1. An automatic silk-screen printing machine including means for synchronized control of movements comprising a relative linear movement between the screen and the doctor blade, a downward movement of the doctor blade and a simultaneous upward movement of the member which holds the object to be printed, in which the mechanism for moving the doctor blade holder (14) downwards and upwards includes an electromagnet which controls the downward movement of the doctor blade, characterized in that said mechanism comprises a pivoting arm (15) the pivot point (16) of which is fixed relative to the means for linearly moving the doctor blade, means (18) for yieldingly returning said arm to a position corresponding to the up position of the doctor blade, a member (17) having an abutment surface above said arm, means (23) for applying a downward vertical pressure onto said abutment surface; a link (19) having a pivot pin (190) integral with said arm and at one end of which is mounted the axle of a wheel (191) bearing against said abutment surface, a rod (20) connected at one end thereof to said link so as to cause it to oscillate about its pivot pin, and said electromagnet (21) which has a movable member integral with the opposite end of said rod and means for causing energization of the electromagnet throughout the printing period.

2. A machine according to claim 1, characterized by means (22, 230) for setting the pressure applied onto said member (17) having an abutment surface.

* * * * *